US009899720B2

(12) United States Patent
Morgan et al.

(10) Patent No.: US 9,899,720 B2
(45) Date of Patent: Feb. 20, 2018

(54) DIELECTRIC WAVEGUIDE COMPRISED OF A CLADDING OF OBLONG CROSS-SECTIONAL SHAPE SURROUNDING A CORE OF CURVED CROSS-SECTIONAL SHAPE

(71) Applicants: Tyco Electronics Corporation, Berwyn, PA (US); Tyco Electronics (Shanghai) Co., Ltd., Shanghai (CN)

(72) Inventors: Chad Morgan, Carneys Point, NJ (US); Liang Huang, Chengdu (CN)

(73) Assignees: TE CONNECTIVITY CORPORATION, Berwyn, PA (US); TYCO ELECTRONICS (SHANGHAI) CO., LTD., Shanghai (CN)

( * ) Notice: Subject to any disclaimer, the term of this patent is extended or adjusted under 35 U.S.C. 154(b) by 8 days.

(21) Appl. No.: 14/832,581

(22) Filed: Aug. 21, 2015

(65) Prior Publication Data

US 2017/0040658 A1 Feb. 9, 2017

(30) Foreign Application Priority Data

Aug. 6, 2015 (CN) ..... 2015 1 0477529

(51) Int. Cl.
*H01P 3/16* (2006.01)

(52) U.S. Cl.
CPC ..... *H01P 3/16* (2013.01)

(58) Field of Classification Search
CPC .... H01P 3/16; H01P 3/20; H01P 3/121; H01P 3/122
USPC ..... 333/239, 241, 242
See application file for complete search history.

(56) References Cited

U.S. PATENT DOCUMENTS

| | | | | |
|---|---|---|---|---|
| 4,293,833 | A | 10/1981 | Popa | |
| 4,441,091 | A * | 4/1984 | Nishida et al. | H01Q 13/20 333/236 |
| 4,800,350 | A | 1/1989 | Bridges et al. | |
| 5,889,449 | A | 3/1999 | Fiedziuszko | |
| 2006/0093275 | A1 | 5/2006 | Lagace et al. | |
| 2014/0240062 | A1 | 8/2014 | Herbsommer et al. | |
| 2014/0285293 | A1 | 9/2014 | Schuppener et al. | |

(Continued)

FOREIGN PATENT DOCUMENTS

| | | | |
|---|---|---|---|
| EP | 0318198 | A1 | 5/1989 |
| JP | S51138369 | A | 11/1976 |

OTHER PUBLICATIONS

International Search Report, International Application No. PCT/US2016/045076, International Filing Date Aug. 2, 2016.

(Continued)

*Primary Examiner* — Benny Lee

(57) ABSTRACT

A dielectric waveguide for propagating electromagnetic signals includes a cladding member. The cladding member extends a length between two ends. The cladding member has an oblong cross sectional shape. The cladding member is formed of a first dielectric material. The cladding member defines a core region that extends through the cladding member the length of the cladding member. The core region has a circular cross sectional shape. The core region is filled with a second dielectric material having a dielectric constant value that differs from a dielectric constant value of the first dielectric material of the cladding member.

20 Claims, 2 Drawing Sheets

(56) References Cited

U.S. PATENT DOCUMENTS

| | | | |
|---|---|---|---|
| 2014/0368301 | A1 | 12/2014 | Herbsommer et al. |
| 2017/0040659 | A1 | 2/2017 | Morgan et al. |

OTHER PUBLICATIONS

E. Yamashita et al., "Composite Dielectric Waveguides with Two Elliptic-Cylinder Boundaries", IEEE Transactions on Microwave Theory and Techniques, Sep. 1, 1981, pp. 987-990, vol. MTT-29, No. 9, IEEE Service Center, Piscataway, US.

T. Kosugi et al., "Densely-Aligned Multi-Channel Polymer Oprical Waveguide with Graded-Index Cores for Simple Implementation on Printed Circuit", Electronic Components and Technology Conference, May 26, 2009, pp. 201-206, IEEE, Piscataway, US.

F. Doany et al., "Multichannel High-Bandwith Coupling of Ultradense Silicon Photonic Waveguide Array to Standard-Pitch Fiber Array", Journal of Lightwave Technology, Feb. 1, 2011, p. 475-482, vol. 29, No. 4, IEEE Service Center, New York, US.

D. Pavlidis et al., "Circular Composite Dielectric Waveguides and Their Applications in HE11 Mode High Power Microwave Heating Systems", 8th European Microwave Conference 78, Jan. 1, 1978, pp. 584-588, No. 139.

R. Chou et al., "Modal Attenuation in Multilayered Coated Waveguides", IEEE Transactions on Microwave Theory and Techniques, Jul. 1, 1988, pp. 1167-1176, vol. 36, No. 7, IEEE Service Center, Piscataway, US.

* cited by examiner

DIELECTRIC WAVEGUIDE COMPRISED OF A CLADDING OF OBLONG CROSS-SECTIONAL SHAPE SURROUNDING A CORE OF CURVED CROSS-SECTIONAL SHAPE

CROSS-REFERENCE TO RELATED APPLICATIONS

This application claims priority to Chinese Patent Application No. 201510477529.7, filed on 6 Aug. 2015, which is incorporated by reference herein in its entirety.

BACKGROUND OF THE INVENTION

The subject matter herein relates generally to dielectric waveguides.

Dielectric waveguides are used in communications applications to convey electromagnetic waves along a path between two ends. Dielectric waveguides may provide communication transmission lines for connecting antennas to radio frequency transmitters and receivers and in other applications. For example, although electromagnetic waves in open space propagate in all directions, dielectric waveguides direct the electromagnetic waves along a defined path, which allows the waveguides to transmit high frequency signals over relatively long distances.

Dielectric waveguides include at least one dielectric material. A dielectric is an electrical insulating material that can be polarized by an applied electrical field. The polarizability of a dielectric material is expressed by a value called the dielectric constant or relative permittivity. The dielectric constant of a given material is its dielectric permittivity expressed as a ratio relative to the permittivity of a vacuum, which is 1 by definition. A first dielectric material with a greater dielectric constant than a second dielectric material is able to store more electrical charge by means of polarization than the second dielectric material.

Some known dielectric waveguides include a core dielectric material and a cladding dielectric material that surrounds the core dielectric material. The cladding may be used to isolate electromagnetic wave signals traveling through the core from external influences which may interfere with the signal transmission and degrade the signal. For example, such external influences may include a human hand that touches the dielectric waveguide and/or another conductive component that contacts or comes in close proximity to the waveguide. The cladding layer around the core is typically circular. However, a circular cladding layer may make connecting the dielectric waveguide to electrical components or other waveguides difficult. For example, some waveguides include a rectangular or other oblong-shaped core. It is important for the orientation of the core of a first waveguide to align with the orientation of the core of a second waveguide at a connecting interface in order for the electromagnetic waves to cross the interface between the two waveguides. If the cores and/or claddings of the two waveguides are not properly aligned, at least some of the electrical energy being conveyed through the waveguides will not bridge the interface between the waveguides. For example, the shapes of the core and cladding orient the electrical field orientation or polarization through the waveguide. If the cores are rotationally offset relative to one another, then the electromagnetic waves through the first waveguide may be polarized or oriented differently than the electromagnetic waves through the second waveguide. As a result, the electromagnetic waves from the first waveguide may reflect at the interface instead of being received across the interface into the second waveguide. Since the cladding is circular, there is no planar surface or angled edge along a perimeter of the cladding that can be used for aligning the two waveguides together such that both the cores and claddings have matching orientations. Thus, one of the waveguides may roll relative to the other, which misaligns the waveguides and may result in degraded signal transmission across the interface between the waveguides.

A need remains for a dielectric waveguide that provides better mechanical alignment for connecting the waveguide to other waveguides and electrical components in order to increase the quality and integrity of signal transmission across a connection interface.

SUMMARY OF THE INVENTION

In an embodiment, a dielectric waveguide for propagating electromagnetic signals is provided that includes a cladding member. The cladding member extends a length between two ends. The cladding member has an oblong cross sectional shape. The cladding member is formed of a first dielectric material. The cladding member defines a core region that extends through the cladding member the length of the cladding member. The core region has a circular cross sectional shape. The core region is filled with a second dielectric material having a dielectric constant value that differs from a dielectric constant value of the first dielectric material of the cladding member.

In another embodiment, a dielectric waveguide for propagating electromagnetic signals is provided that includes a core member and a cladding member. The core member extends a length between two ends. The core member has a circular cross sectional shape. The core member is formed of a first dielectric material. The cladding member surrounds the core member along the length of the core member. The cladding member has an oblong cross sectional shape. The cladding member is formed of a second dielectric material having a dielectric constant value that differs from a dielectric constant value of the first dielectric material of the core member.

In yet another embodiment, a dielectric waveguide for propagating electromagnetic signals is provided that includes a core member and a cladding member. The core member extends a length between two ends. The core member is formed of a first dielectric material having a dielectric constant value less than 3. The cladding member surrounds the core member along the length of the core member. The cladding member has an oblong cross sectional shape. The cladding member is formed of a second dielectric material having a dielectric constant value that is between 3 and 7.

DETAILED DESCRIPTION OF THE INVENTION

Figure 1:
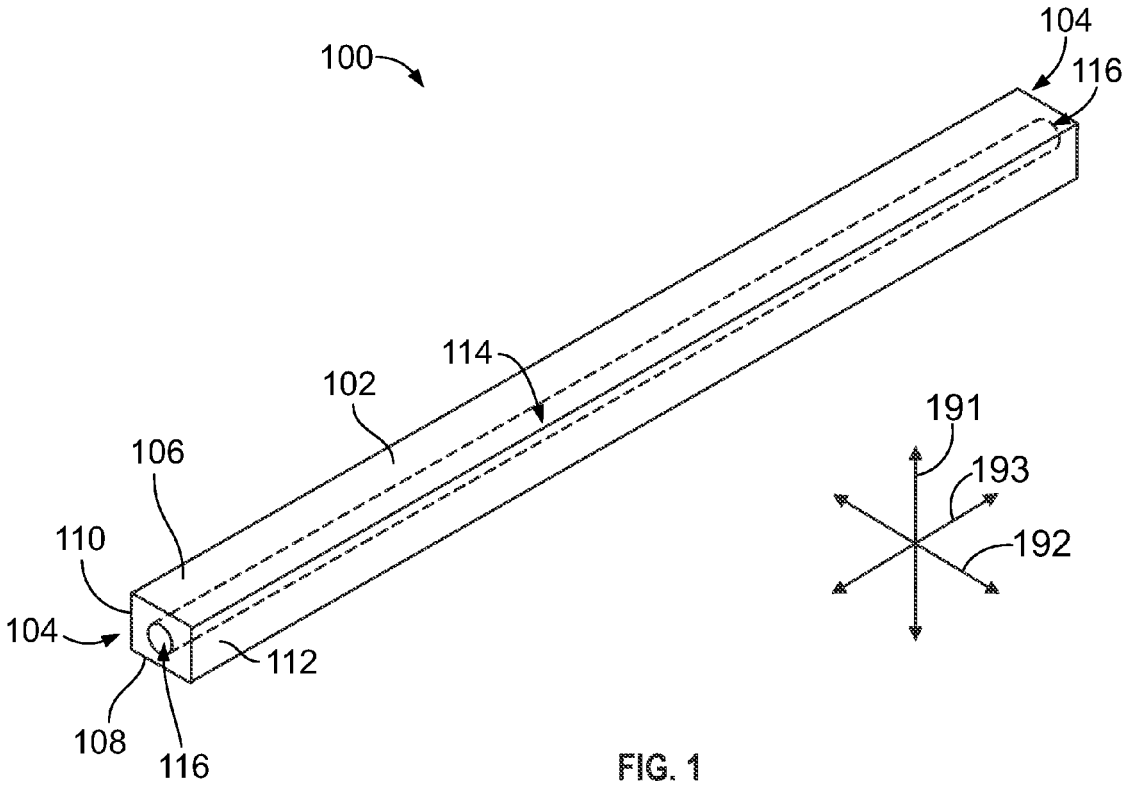
FIG. 1 is a top perspective view of a dielectric waveguide formed in accordance with an embodiment.

FIG. 1 is a top perspective view of a dielectric waveguide 100 formed in accordance with an embodiment. The dielectric waveguide 100 is configured to convey electromagnetic signals along a length of the waveguide 100 for transmission of the electromagnetic signals to or from an antenna, a radio frequency transmitter and/or receiver, or another electrical component. The electromagnetic signals may be in the form of electromagnetic waves. The dielectric waveguide 100 may be used to transmit sub-terahertz radio frequency signals, such as in the range of 120-160 GHz. The signals are millimeter-wave signals since the signals in this frequency range have wavelengths less than five millimeters. The dielectric waveguide 100 may be used to transmit modulated radio frequency (RF) signals. The modulated RF signals may be modulated in orthogonal mathematical domains to increase data throughput. The dielectric waveguide 100 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity. The dielectric waveguide 100 extends a length along the longitudinal axis 193 between two ends 104.

The dielectric waveguide 100 includes a cladding member 102 that extends the length of the dielectric waveguide 100. The cladding member 102 is formed of a dielectric material, referred to herein as a cladding material. Thus, the cladding material is an electrical insulator that may be polarized by an applied electric field. The cladding member 102 has an oblong cross sectional shape. For example, the cross sectional shape of the cladding member 102 is longer in one direction than in another direction. The oblong shape of the cladding member 102 may orient the electromagnetic waves that propagate through the dielectric waveguide 100 in a horizontal or vertical polarization. The cladding member 102 may be rectangular with right angle corners, rectangular with curved corners, trapezoidal, elliptical, oval, or the like. In the illustrated embodiment, the cladding member 102 has a top side 106, a bottom side 108, a left side 110, and a right side 112. As used herein, relative or spatial terms such as "first," "second," "top," "bottom," "left," and "right" are only used to distinguish the referenced elements and do not necessarily require particular positions, orders, or orientations in the dielectric waveguide 100 or in the surrounding environment of the dielectric waveguide 100.

The cladding member 102 defines a core region 114 that extends through the cladding member 102 for the length of the cladding member 102 between the two ends 104. The core region 114 includes an opening 116 at both ends 104 of the cladding member 102. In the illustrated embodiment, the core region 114 has a circular cross sectional shape. In an alternative embodiment, the core region 114 may have an oblong cross sectional shape. The core region 114 is filled with a dielectric material, referred to herein as a core material. The core material has a dielectric constant that is different from the dielectric constant of the cladding material.

The different dielectric constants of the core material and the cladding material affect the distribution of the electric field within the waveguide 100. For example, the electric field through the waveguide 100 may concentrate within the material having the greater dielectric constant, at least for two dielectric materials having dielectric constants in the range of 0-15. Thus, if the cladding material has a dielectric constant that is greater than the core material, a majority of the electric field is distributed within the cladding member 102 (such that the field strength is greatest within the cladding member 102), although some of the electric field may be distributed within the core region 114 and/or outside of the cladding member 102. On the other hand, if the core material has a greater dielectric constant than the core material, a majority of the electric field may be distributed within the core region 114 and a minority of the field is within the cladding member 102 and/or outside of the cladding member 102.

In an embodiment, at least one of the sides 106, 108, 110, 112 of the dielectric waveguide 100 is planar or includes at least a planar surface. The at least one planar side may be used as a reference surface for mechanically aligning the waveguide 100 in an interconnection with a connecting waveguide (not shown), a connector, an antenna, or another electrical component. For example, the waveguide 100 may be configured to be connected to a connecting waveguide that is substantially identical to the waveguide 100 (except perhaps for length) by abutting one end 104 of the waveguide 100 against an end of the connecting waveguide at an interface to form a butt joint. The one or more reference surfaces of the waveguide 100 may be aligned with a complementary planar side of the connecting waveguide to ensure that the cladding member 102 and the core region 114 align with the respective cladding member and core region of the connecting waveguide. In the illustrated embodiment, all four sides 106-112 are planar, such that each of the sides 106, 108, 110, 112 may be a reference surface used to align the waveguide 100 in an interconnection.

Figure 2:
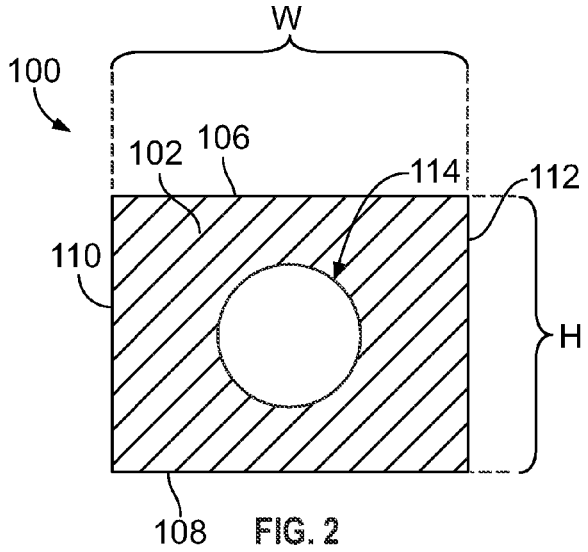
FIG. 2 is a cross-sectional view of the dielectric waveguide according to a first embodiment.

FIG. 2 is a cross-sectional view of the dielectric waveguide 100 according to a first embodiment. In the illustrated embodiment, the core region 114 defined by the cladding member 102 is filled with air. Air defines the core dielectric material within the core region 114. Thus, the core region 114 is not filled with a solid material. Air has a dielectric constant that is approximately 1. The cladding material of the cladding member 102 has a dielectric constant that is greater than the dielectric constant of air. For example, the cladding material may have a dielectric constant between 2 and 15. More specifically, the cladding material may have a dielectric constant between 3 and 7. As used herein, a range that is "between" two end values is meant to be inclusive of the end values. Since the dielectric constant of the cladding material is greater than the dielectric constant of air, a majority of the electric field through the waveguide 100 is distributed within the cladding member 102. In an embodiment, the dielectric constant value of the cladding material may be between 3 and 4 such that the difference in dielectric constant values between the core material within the core region 114 and the cladding material within the cladding member 102 is between 2 and 3. Thus, due to the relatively small difference in dielectric constant values, the field strength of the electric field is distributed within both the cladding member 102 and the core region 114, although the majority of the field strength is in the cladding member 102.

The cladding material of the cladding member 102 may be a dielectric polymer, such as a plastic or another synthetic polymer. For example, the cladding material may be polypropylene, polyethylene, polytetrafluoroethylene (PTFE), polystyrene, nylon, a polyimide, or the like, including combinations thereof. Such polymers may reduce loss through the dielectric waveguide 100, allowing signals to propagate farther than other waveguide materials. In other embodiments, the cladding dielectric material may be or include paper, mica, rubber, salt, concrete, Neoprene synthetic rubber, Pyrex® borosilicate glass, silicon dioxide, or the like. The cladding member 102 may be flexible or semi-rigid.

In the illustrated embodiment, the top side 106 and the bottom side 108 of the cladding member 102 are longer than the left side 110 and the right side 112 of the cladding member 102. As such, the cladding member 102 has a width (W) that is greater than a height (H) of the cladding member 102. The electromagnetic waves may be oriented with a horizontal polarization due to the width being greater than the height. In the illustrated embodiment, the cladding member 102 is rectangular. For example, the top side 106 is parallel to the bottom side 108, the left side 110 is parallel to the right side 112, and the cladding member 102 defines right angles between adjacent sides 106, 108, 110, 112. Each of the sides 106, 108, 110 112 is planar. The cladding member 102 in FIG. 2 thus includes two pairs of opposing planar sides, where the first pair is the top and bottom sides 106, 108 and the second pair is the left and right sides 110, 112. In an alternative embodiment, however, the cladding member 102 may include only one pair of opposing planar sides, which orients the electric field within the cladding member 102. The planar sides also serve as reference surfaces for mechanically aligning the waveguide 100 in an interconnection.

The cladding member 102 may have various dimensions. In an embodiment, the cladding member 102 has a height of approximately 0.8 mm and a width of approximately 1.2 mm. The aspect ratio for the width to the height is less than two in the illustrated embodiment. The aspect ratio may be at least two in alternative embodiments. As described above, the cladding member 102 may have other oblong shapes in other embodiments, such as rectangular with rounded corners, trapezoidal, elliptical, oval, or the like.

The cladding member 102 may be fabricated using standard manufacturing processes and/or techniques, such as by extrusion, drawing, fusing, molding, or the like. In one example, the cladding member 102 is extruded to form the cladding member 102 and define the core region 114 within the interior of the cladding member 102. The core region 114 may have various sizes relative to the cladding member 102. In an embodiment, the diameter of the circular core region 114 is approximately half of the height of the cladding member 102 (such as 0.4 mm), and the core region 114 is located along a center region of the cladding member 102.

Figure 3:
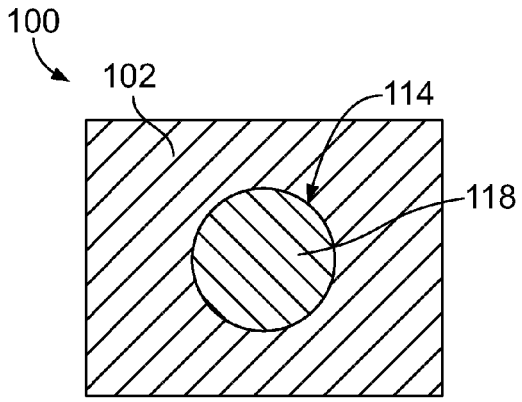
FIG. 3 is a cross-sectional view of the dielectric waveguide according to a second embodiment.

FIG. 3 is a cross-sectional view of the dielectric waveguide 100 according to a second embodiment. In the embodiment shown in FIG. 3, the dielectric waveguide 100 includes a core member 118 within the core region 114 of the cladding member 102. The core member 118 extends the length of the dielectric waveguide 100 between the two ends 104 (shown in FIG. 1). The core member 118 fills the core region 114 such that no clearances or gaps exist between an outer surface of the core member 118 and an inner surface of the cladding member 102. The cladding member 102 engages and surrounds the core member 118 along the length of the core member 118.

The core member 118 is formed of the core dielectric material mentioned in FIG. 1. The core dielectric material of the core member 118 in an embodiment is a solid dielectric material, and is not air as is shown in FIG. 2. For example, the cladding member 102 and the core member 118 of the dielectric waveguide 100 may both be formed of dielectric polymers, such as plastics or other synthetic polymers. The core member 118 may include one or more of polypropylene, polyethylene, polytetrafluoroethylene (PTFE), polystyrene, or the like. The core material of the core member 118 differs from the cladding material that forms the cladding member 102.

In one embodiment, the dielectric constant of the core material is less than the dielectric constant of the cladding material. The core material may have a dielectric constant less than 3, while the cladding material has a dielectric constant between 3 and 12, or more specifically between 3 and 7. In an embodiment, the dielectric constant value of the core material differs from the dielectric constant value of the cladding material by less than 5. For example, the difference in the respective dielectric constants may be between 1.5 and 3. In an example embodiment, the core material of the core member 118 may be PTFE, having a dielectric constant of 2.1, and the cladding material of the cladding member 102 may be nylon, having a dielectric constant of approximately 4 (with the difference between the dielectric constants being 1.9). In an alternative embodiment, the dielectric constant of the core material may be greater than the dielectric constant of the cladding material.

Optionally, the dielectric waveguide 100 shown in FIG. 3 may be fabricated using standard manufacturing processes and/or techniques, such as by extrusion, drawing, fusing, molding, or the like. In one example, the core dielectric material and the cladding dielectric material are co-extruded such that the core member 118 and the cladding member 102 are formed simultaneously. Alternatively, the core member 118 may be pre-formed and the cladding dielectric material may be extruded, molded, drawn, or the like, over the core member 118 to form the cladding member 102 around the core member 118.

In the illustrated embodiment, the core member 118 has a circular cross sectional shape. It may be beneficial for the core member 118 to have a circular shape because it may be easier to extrude or otherwise form the core member 118 in a circular shape than in an oblong shape. Since the cladding member 102 has an oblong shape, the cladding member 102 functions to orient the electric field in the dielectric waveguide 100 instead of the core member 118. Although core member 118 is circular in the illustrated embodiment, in an alternative embodiment the core member 118 may be oblong or have a different cross sectional shape.

Figure 4:
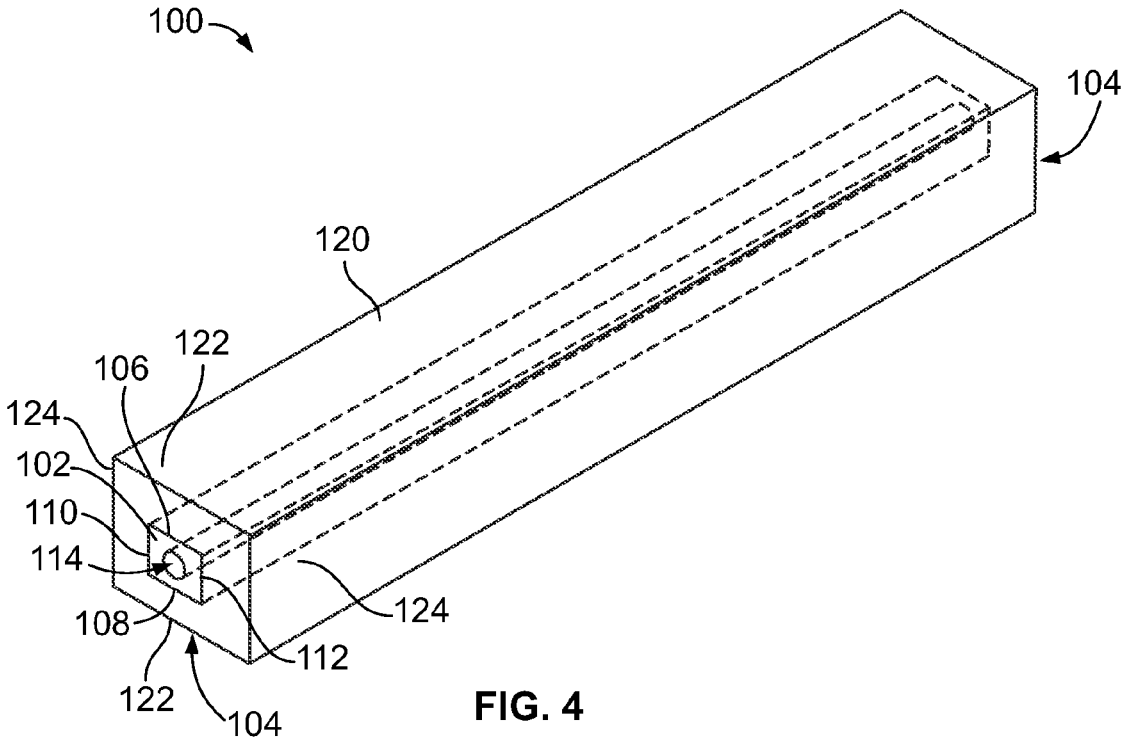
FIG. 4 is a top perspective view of the dielectric waveguide according to an alternative embodiment.

FIG. 4 is a top perspective view of the dielectric waveguide 100 according to an alternative embodiment. The embodiment of the dielectric waveguide 100 shown in FIG. 4 differs from the embodiment shown in FIG. 1 because the waveguide 100 in FIG. 4 includes an outer jacket 120 that surrounds the cladding member 102 along the length of the waveguide 100. The outer jacket 120 may be used to better isolate the electromagnetic signals within the waveguide 100 from external influences that may interfere and degrade the signal transmission. For example, the outer jacket 120 may be formed of a dielectric material, referred to as a jacket material, which has a dielectric constant value that is less than the dielectric constant value of the cladding material. Since the cladding material has a greater dielectric constant than the jacket material, the electric field is concentrated in the cladding member 102 rather than in the outer jacket 120. Therefore, a majority of the electric field is spaced apart from the boundary between the outer jacket 120 and the external environment, where external influences such as a human touch may disturb the field along the boundary. The jacket material may have a dielectric constant that is greater than, less than, or equal to the core material within the core region 114 of the cladding member 102. For example, the jacket material optionally may be the same material as the core material.

In the illustrated embodiment, the outer jacket 120 has an oblong cross sectional shape. For example, the outer jacket 120 is rectangular with two opposing longer sides 122 and two opposing shorter sides 124. The longer sides 122 align with the longer top and bottom sides 106, 108 of the cladding member 102 such that the longer sides 122 are parallel to the top and bottom sides 106, 108. In addition, the shorter sides 124 align with the shorter left and right sides 110, 112 of the cladding member 102 such that the shorter sides 124 are parallel to the left and right sides 110, 112. Although the outer jacket 120 obstructs the view of the cladding member 102 within the outer jacket 120, when connecting the dielectric waveguide 100 to an identical or substantially similar connecting waveguide, an operator or a machine may align the two waveguides by aligning the outer jacket 120 of the waveguide 100 with the outer jacket of the connecting waveguide. For example, the jackets may be aligned by arranging the longer sides 122 of the jacket 120 with the corresponding longer sides of the outer jacket of the connecting waveguide to provide a continuous plane extending across the connection interface. Such alignment of the jackets also aligns the cladding member 102 within the waveguide 100 with the cladding of the connecting waveguide. As a result, the polarized electromagnetic waves within the dielectric waveguide 100 are readily received across the interface and into the connecting waveguide without being reflected back into the dielectric waveguide 100.

In an alternative embodiment, the outer jacket 120 may have a circular or square cross sectional shape instead of having an oblong shape. In order to align the dielectric waveguide 100 with a connecting waveguide, a segment of the jacket 120 at one or both of the ends 104 of the waveguide 100 may be stripped or otherwise removed to expose the oblong cladding member 102. The exposed cladding member 102 may be used to align the waveguide 100 with the connecting waveguide. Optionally, a dielectric tape or the like may be applied around the exposed cladding member 102 after the connection is made in order to reduce interference caused by external influences.

Figure 5:
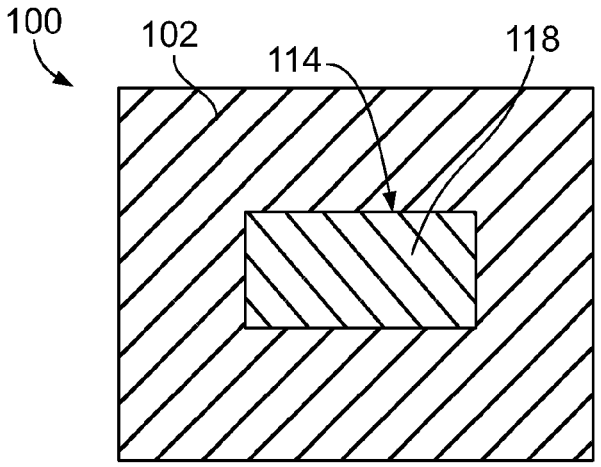
FIG. 5 is a cross-sectional view of the dielectric waveguide according to another alternative embodiment.

FIG. 5 is a cross-sectional view of the dielectric waveguide 100 according to another alternative embodiment. In FIG. 5, the core region 114 defined by the cladding member 102 has an oblong cross sectional shape. In the illustrated embodiment, the core region 114 is filled by a solid core member 118, but the core region 114 may be filled with air in an alternative embodiment. The core member 118 may be formed of a dielectric material that has a dielectric constant value that is less than a dielectric constant value of the cladding material of the cladding member 102. As such, the electric field within the waveguide 100 may be distributed primarily within the cladding member 102, with less of the field being within the core member 118. For example, the dielectric constant of the core material of the core member 118 may be less than 3, and the dielectric constant of the cladding material of the cladding member 102 may be between 3 and 7. Optionally, the embodiment of the waveguide 100 shown in FIG. 5 may be surrounded by an outer jacket, such as the outer jacket 120 shown in FIG. 4. Although the core member 118 has a rectangular cross sectional shape with right angle corners in the illustrated embodiment, the core member 118 may have other oblong shapes in other embodiments, such as elliptical, oval, trapezoidal, rectangular with rounded corners, or the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C.§112(f), unless and until such claim limitations expressly use the phrase "means for" followed by a statement of function void of further structure.

What is claimed is:

1. A dielectric waveguide for propagating electromagnetic signals, the dielectric waveguide comprising:

a cladding member extending a length between two ends, the cladding member having an oblong cross sectional shape, the cladding member being formed of a first dielectric material, the cladding member defining a core region that extends the length of the cladding member, the core region having a circular cross sectional shape, the core region being filled with a second dielectric material having a dielectric constant value that differs from a dielectric constant value of the first dielectric material of the cladding member, wherein the dielectric constant value of the first dielectric material of the cladding member is greater than the dielectric constant value of the second dielectric material within the core region.

2. The dielectric waveguide of claim 1, wherein the second dielectric material that fills the core region is air.

3. The dielectric waveguide of claim 1, wherein the second dielectric material that fills the core region is a dielectric polymer.

4. The dielectric waveguide of claim 1, wherein the oblong cross sectional shape of the cladding member is rectangular.

5. The dielectric waveguide of claim 1, wherein the dielectric constant value of the first dielectric material of the cladding member is between 3 and 7 and the dielectric constant value of the second dielectric material within the core region is less than 3.

6. The dielectric waveguide of claim 1, wherein the oblong cross sectional shape of the cladding member includes at least one pair of opposing planar sides that are parallel to one another.

7. The dielectric waveguide of claim 1, wherein the first dielectric material of the cladding member is a dielectric polymer.

8. The dielectric waveguide of claim 1, further comprising an outer jacket surrounding the cladding member, the outer jacket being formed of a dielectric material that has a dielectric constant value less than the dielectric constant value of the first dielectric material of the cladding member.

9. The dielectric waveguide of claim 8, wherein the outer jacket has an oblong cross sectional shape.

10. The dielectric waveguide of claim 8, wherein the outer jacket has a cross sectional shape that includes at least one pair of opposing planar sides that are parallel to one another.

11. A dielectric waveguide for propagating electromagnetic signals, the dielectric waveguide comprising:

a core member extending a length between two ends, the core member having a curved cross sectional shape, the core member being formed of a first dielectric material; and a cladding member surrounding the core member along the length of the core member, the cladding member having an oblong cross sectional shape that includes at least one pair of opposing planar sides that are parallel to one another, the cladding member being formed of a second dielectric material having a dielectric constant value that differs from a dielectric constant value of the first dielectric material of the core member.

12. The dielectric waveguide of claim 11, wherein the curved cross sectional shape of the core member is circular.

13. The dielectric waveguide of claim 11, wherein the first and second dielectric materials are different dielectric polymers.

14. The dielectric waveguide of claim 11, wherein the dielectric constant value of the first dielectric material of the core member is less than the dielectric constant value of the second dielectric material of the cladding member.

15. The dielectric waveguide of claim 14, wherein the dielectric constant value of the first dielectric material of the core member is less than 3 and the dielectric constant value of the second dielectric material of the cladding member is between 3 and 7.

16. The dielectric waveguide of claim 11, wherein the dielectric constant value of the first dielectric material of the core member is greater than the dielectric constant value of the second dielectric material of the cladding member.

17. The dielectric waveguide of claim 11, wherein the curved cross sectional shape of the core member is at least one of an ellipse, an oval, or a rectangle with rounded corners.

18. The dielectric waveguide of claim 11, further comprising an outer jacket surrounding the cladding member, the outer jacket being formed of a dielectric material that has a dielectric constant value less than the dielectric constant value of the second dielectric material of the cladding member.

19. A dielectric waveguide for propagating electromagnetic signals, the dielectric waveguide comprising:

a core member extending a length between two ends, the core member being formed of a first dielectric material having a dielectric constant value less than 3; and a cladding member surrounding the core member along the length of the core member, the cladding member having an oblong cross sectional shape, the cladding member being formed of a second dielectric material having a dielectric constant value that is between 3 and 7.

20. The dielectric waveguide of claim 19, wherein the core member has an oblong cross sectional shape.

* * * * *